US010392895B1

(12) United States Patent
Pruitt et al.

(10) Patent No.: US 10,392,895 B1
(45) Date of Patent: Aug. 27, 2019

(54) FLUID CONTAINMENT SYSTEM AND METHOD

(71) Applicants: Grant Pruitt, Fort Smith, AR (US); Benjamin Micah Spahn, Alma, AR (US); Andrew Lloyd Plowman, Charleston, AR (US)

(72) Inventors: Grant Pruitt, Fort Smith, AR (US); Benjamin Micah Spahn, Alma, AR (US); Andrew Lloyd Plowman, Charleston, AR (US)

(73) Assignee: PRUITT TOOL & SUPPLY CO., Fort Smith, AR (US)

( * ) Notice: Subject to any disclaimer, the term of this patent is extended or adjusted under 35 U.S.C. 154(b) by 0 days.

(21) Appl. No.: 15/673,395

(22) Filed: Aug. 9, 2017

Related U.S. Application Data

(63) Continuation-in-part of application No. 62/372,651, filed on Aug. 9, 2016.

(51) Int. Cl.
*E21B 33/08* (2006.01)

(52) U.S. Cl.
CPC ..... *E21B 33/08* (2013.01)

(58) Field of Classification Search
CPC ..... E21B 33/08
See application file for complete search history.

(56) References Cited

U.S. PATENT DOCUMENTS

| | | | | | |
|---|---|---|---|---|---|
| 560,986 | A * | 5/1896 | Grow | E21B 33/08 | 166/81.1 |
| 4,949,784 | A * | 8/1990 | Evans | E21B 33/08 | 166/165 |
| 5,121,796 | A * | 6/1992 | Wigington, Sr. | E21B 21/01 | 166/379 |
| 5,150,751 | A * | 9/1992 | Burton | E21B 33/08 | 166/81.1 |
| 5,167,277 | A * | 12/1992 | Evans | E21B 21/01 | 166/81.1 |
| 5,228,506 | A * | 7/1993 | Pearce | E21B 33/08 | 166/81.1 |
| 5,394,939 | A * | 3/1995 | Walker | E21B 33/08 | 166/81.1 |
| 6,286,593 | B1 * | 9/2001 | Holtby | E21B 33/03 | 137/15.08 |
| 6,386,225 | B1 * | 5/2002 | Holtby | E21B 33/08 | 137/15.01 |
| 6,666,287 | B2 * | 12/2003 | Holtby | E21B 21/01 | 137/312 |

* cited by examiner

*Primary Examiner* — Matthew R Buck
*Assistant Examiner* — Aaron L Lembo
(74) *Attorney, Agent, or Firm* — Schrantz Law Firm, PLLC; Stephen D. Schrantz

(57) ABSTRACT

The fluid containment system attaches to the wellhead below the rotating control device to catch fluids. The fluid containment system provides a pan below the outlet of the body in which the rotating head assembly is secured. A curtain attaches to the fluid containment system to at least partially enclose the wellhead. The curtain directs the escaped fluids to the pan. An opening in the curtain provides an outlet for the body allowing fluids within the pipe to flow from the body. Conduits attach to outlets of the pan to transfer the fluids from the pan to a tank.

20 Claims, 11 Drawing Sheets

FLUID CONTAINMENT SYSTEM AND METHOD

CROSS-REFERENCE TO RELATED APPLICATIONS

This application claims priority to and is a continuation in part of U.S. Patent Application No. 62/372,651 filed on Aug. 9, 2017 entitled FLUID CONTAINMENT SYSTEM AND METHOD.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

In well drilling, fluids are often pumped into and out of the well. Some of these fluids could potentially escape the wellhead. Loss of the fluids could cause potential problems. The present invention captures these fluids to reduce the loss of the fluids. Lost fluids could potentially leak from the wellhead causing problems for the rig operators and the environment. The operators must then remove the fluids. Such cleanup costs money and causes rig non-productive time (NPT).

By reducing the loss of fluids from the wellhead, the present invention increases operation while reducing time spent cleaning. The present invention also provides a safer work environment for operation of the drilling rig and reduces the amount of drilling fluid lost to the environment.

II. Description of the Known Art

Patents and patent applications disclosing relevant information are disclosed below. These patents and patent applications are hereby expressly incorporated by reference in their entirety.

U.S. Pat. No. 6,386,225 issued to Holtby on May 14, 2002 ("the '225 patent") teaches a modular catch pan for wellheads that includes a rigid pan body consisting of two detachably coupled sections, the body having a circular opening. A plurality of split annular adaptor collars taught by the '225 patent are provided. Each of the adaptor collars taught by the '225 patent has the same outer diameter so that any one of them can be fitted into the circular opening. Each of the adaptor collars taught by the '225 patent has an outer circumferential sealing surface adapted to form a seal with the circular opening of the body. Each of the adaptor collars taught by the '225 patent has an inner circumferential sealing surface. The '225 patent teaches that the size of the inner circumferential sealing surface and the distance of the inner circumferential sealing surface from the outer circumferential sealing surface varies between adaptor collars. The modular catch pan taught by the '225 patent can be adapted to fit any installation by selecting a suitable adaptor collar.

These shortcomings are overcome by the invention disclosed herein. Accordingly, it would be desirable to provide an improved device and system for containing fluids leaking from the wellhead.

SUMMARY OF THE INVENTION

The fluid containment system of the present invention attaches to a wellhead device to contain fluids. The fluid containment system of one embodiment provides a pan below the flowline of the rotating control device (RCD) body in which the bearing assembly is secured. A curtain attaches to the fluid containment system to at least partially enclose the wellhead. The curtain directs the escaped fluids to the pan. An opening in the curtain provides a passage through the curtain for the flow line allowing fluids within the pipe to flow from the body.

The fluid containment system provides two pan bodies that secure together. Each pan body provides an outlet or outlets for the fluids to exit the pan. The fluids flow to a containment vessel for storing the fluids.

The present invention reduces the downtime and costs of the drilling rig by reducing time expended removing the fluids. The present invention also provides a safer work environment and reduces the amount of fluid lost to the environment.

It is an object of the present invention to reduce the amount of leaked fluids to the environment.

Another object of the present invention is to capture leaked fluids and properly store the fluids.

Another object of the present invention is to provide a curtain that directs fluids to a pan.

Another object of the present invention is to provide attachment arms for securing the curtain above the pan.

Another object of the present invention is to provide attachment arms that easily adjust between the use position and transport/store position.

Another object of the present invention is to allow for the trouble free operation of the pan.

Another object of the present invention is to create a safer work environment for rig personnel.

Another object of the present invention is to not require attachment to the rig structure.

Another object of the present invention is to simplify the method of assembling the pan.

In addition to the features and advantages of the fluid containment system and method according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
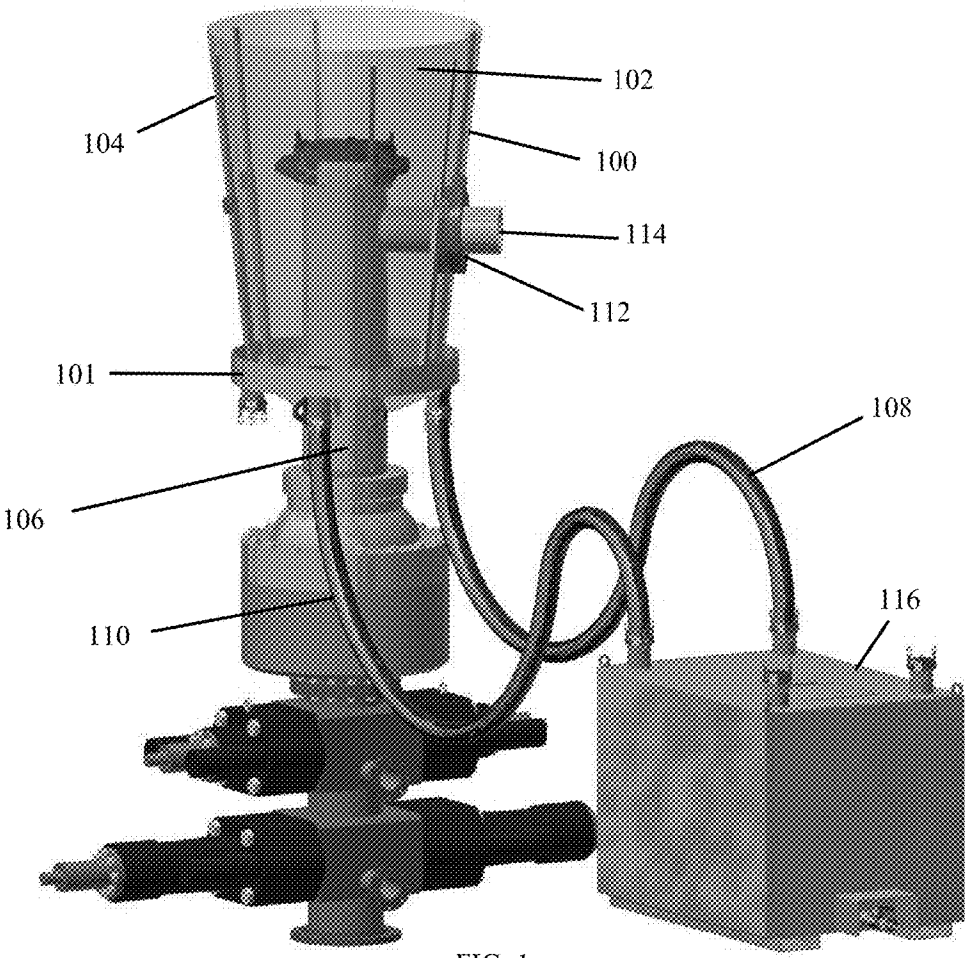
FIG. 1 is an environmental view showing one embodiment of the present invention.

FIG. 1 shows an environmental view of the fluid containment system 100 secured to wellhead 106. Curtain 102 at least partially encloses the rotating control device. The curtain 102 directs leaked fluid from the wellhead device to the pan 101 located below.

Attachment arms 104 extend vertically upward above the pan 101. The curtain 102 secures to the attachment arms 104 and pan 101. The attachment of the curtain 102 to the attachment arms 104 and pan 101 provides a tight attachment that reduces slack and loose material. Removing the slack reduces the areas in which fluid can collect or otherwise be trapped. Therefore, the curtain 102 directs the fluids downwards towards the pan 101 and the outlets.

The curtain provides an aperture 112 for the flow line 114 from the RCD to pass. The aperture 112 may be located closer to the RCD, on a pipe exiting the RCD, or at a flange where pipe connects to the RCD. The aperture 112 allows curtain 102 to better seal the wellhead 106 and the bearing assembly while allowing fluids to flow through the flow line 114.

The leaked fluids from the wellhead device and the bearing assembly are contained by the curtain and flow to the pan 101. Outlets in the pan 101 connect to conduits 108, 110. The curtain 102 restricts flow of the fluid outside of the curtain 102. The fluid flows from pan 101 through the conduits 108, 110 towards containment vessel 116.

Figure 2:
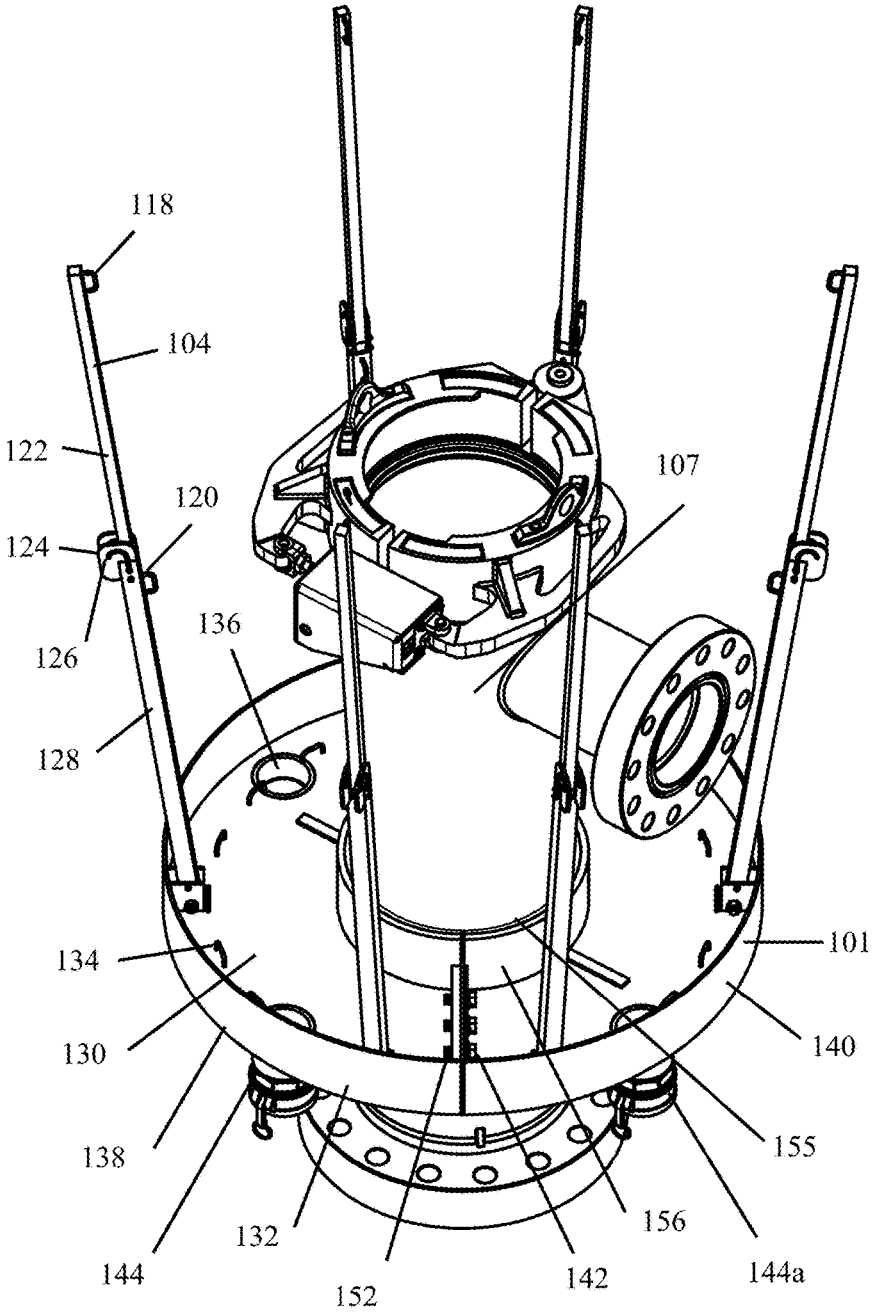
FIG. 2 is an environmental view thereof.

FIG. 2 shows attachment arm 104 attached to pan 101. Attachment fingers 118, 120, 134 provide a surface for securing the curtain to the fluid containment system 101. The arms 104 extend vertically above the pan 101 and body 107. Placement of the curtain above the top of the rotating control device reduces the amount of fluid lost due to insertion of pipe or other objects downhole.

Figure 7:
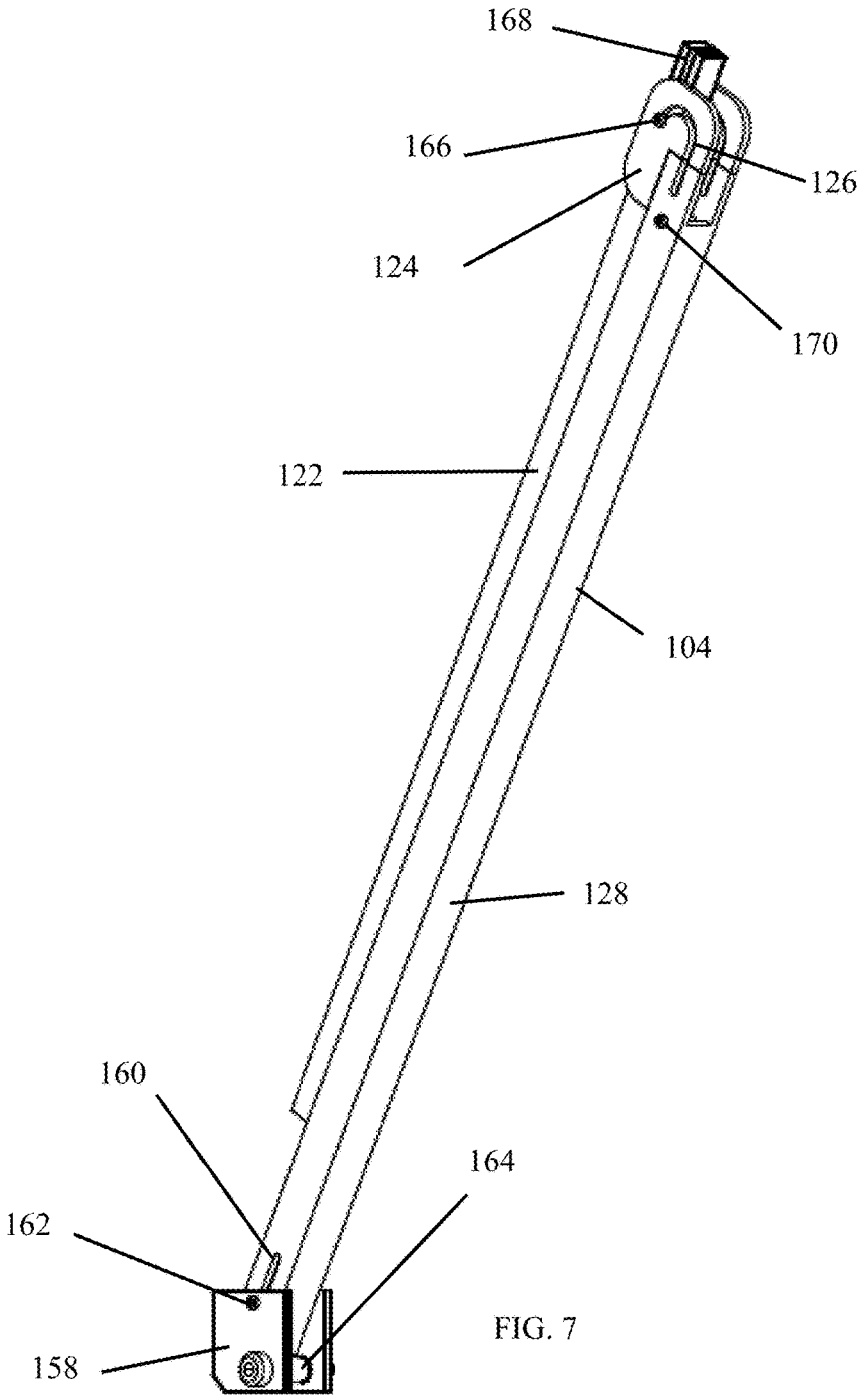
FIG. 7 is a perspective view of an attachment arm thereof.

Attachment arm 104 provides an upper section 122 and a lower section 128 with elbow 124 located between upper section 122 and lower section 128. Attachment arm 104 adjusts between a use position as shown in FIG. 2 and a storage or transport position as shown in FIG. 7. Track 126 through which a pin 166 travels enables the attachment arm 104 to adjust between the use position and the storage/transport position. The attachment arm 104 adjusts onto itself to reduce the length of the attachment arm 104.

The curtain connects to the attachment arm 104 at attachment fingers 118, 120 located on the attachment arm 104. The curtain also connects to the floor 130 of the pan 101. Fasteners, such as a clip, carabiner, connector, or other connection device, secure the curtain to the attachment fingers 118, 120, 134. The fluid exits floor 130 through exit 136 in the floor 130. Conduits 108, 110 connect to the outlets at exit 136 of outlet 144, 144*a*, 144*b*, 144*c*.

The pan bodies 138, 140 fasten together to form pan 101. Each pan body 138, 140 provides an outer wall 132 and inner wall 156 extending above floor 130. The outer wall 132 and inner wall 156 limit the amount of fluid exiting the pan 101.

The pan 101 provides an opening 155 located towards the center of the pan 101. The inner wall 156 is located radially outward from the center of the opening 155. Outer wall 132 is located radially outward from the center of the opening 155 and inner wall 156.

Fasteners 142 insert into attachment wall 152. The attachment walls 152 of pan bodies 138, 140 provide apertures that align with one another. Fasteners 142 then insert into the apertures to secure the pan bodies 138, 140 to each other to form pan 101.

Figure 3:
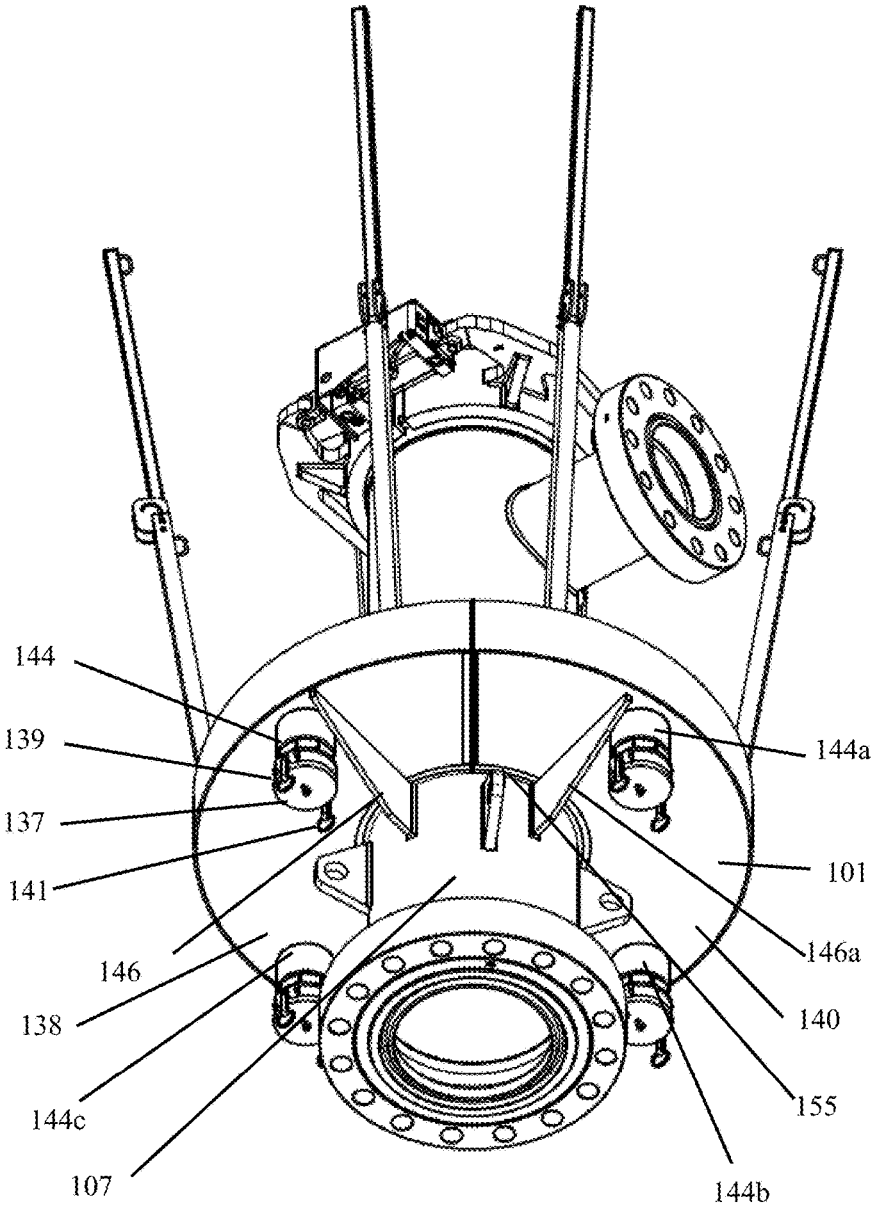
FIG. 3 is an environmental view thereof.
Figure 4:
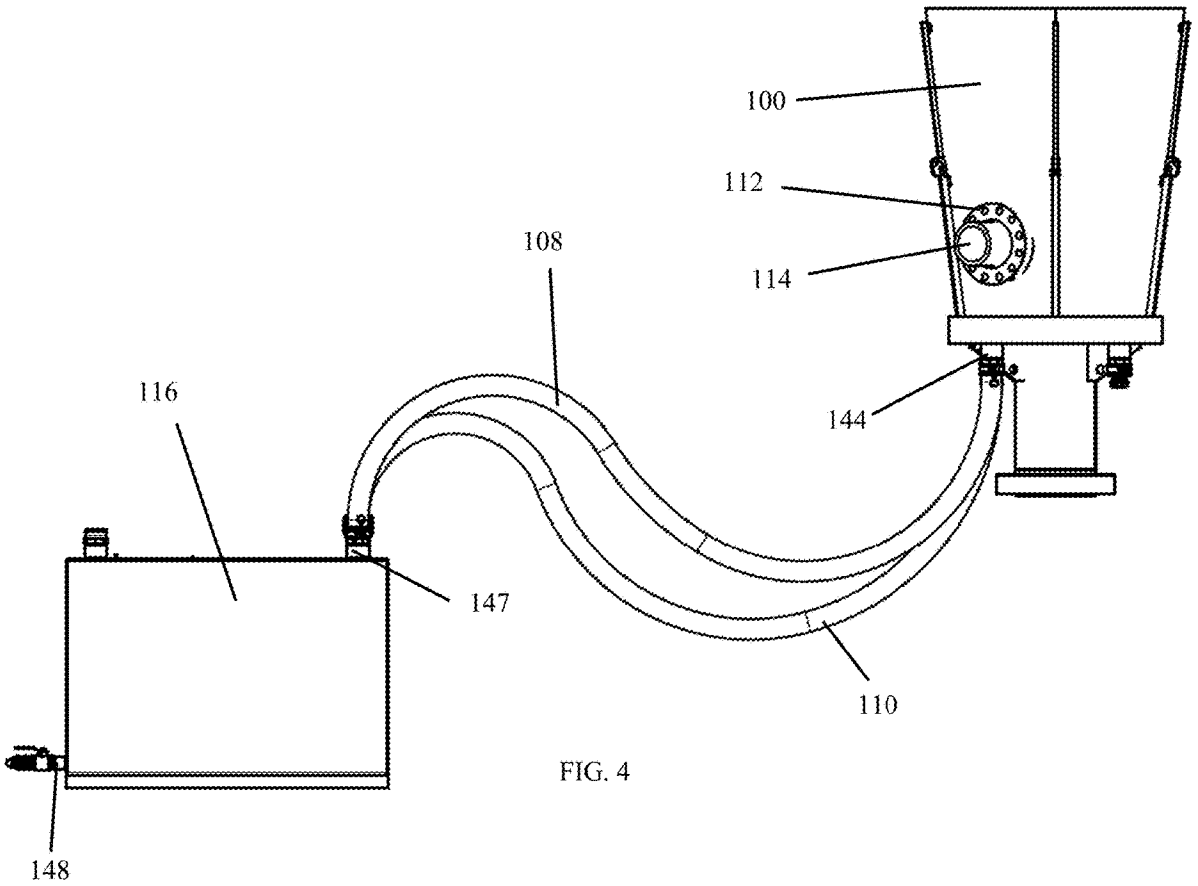
FIG. 4 is an environmental view thereof.
Figure 5:
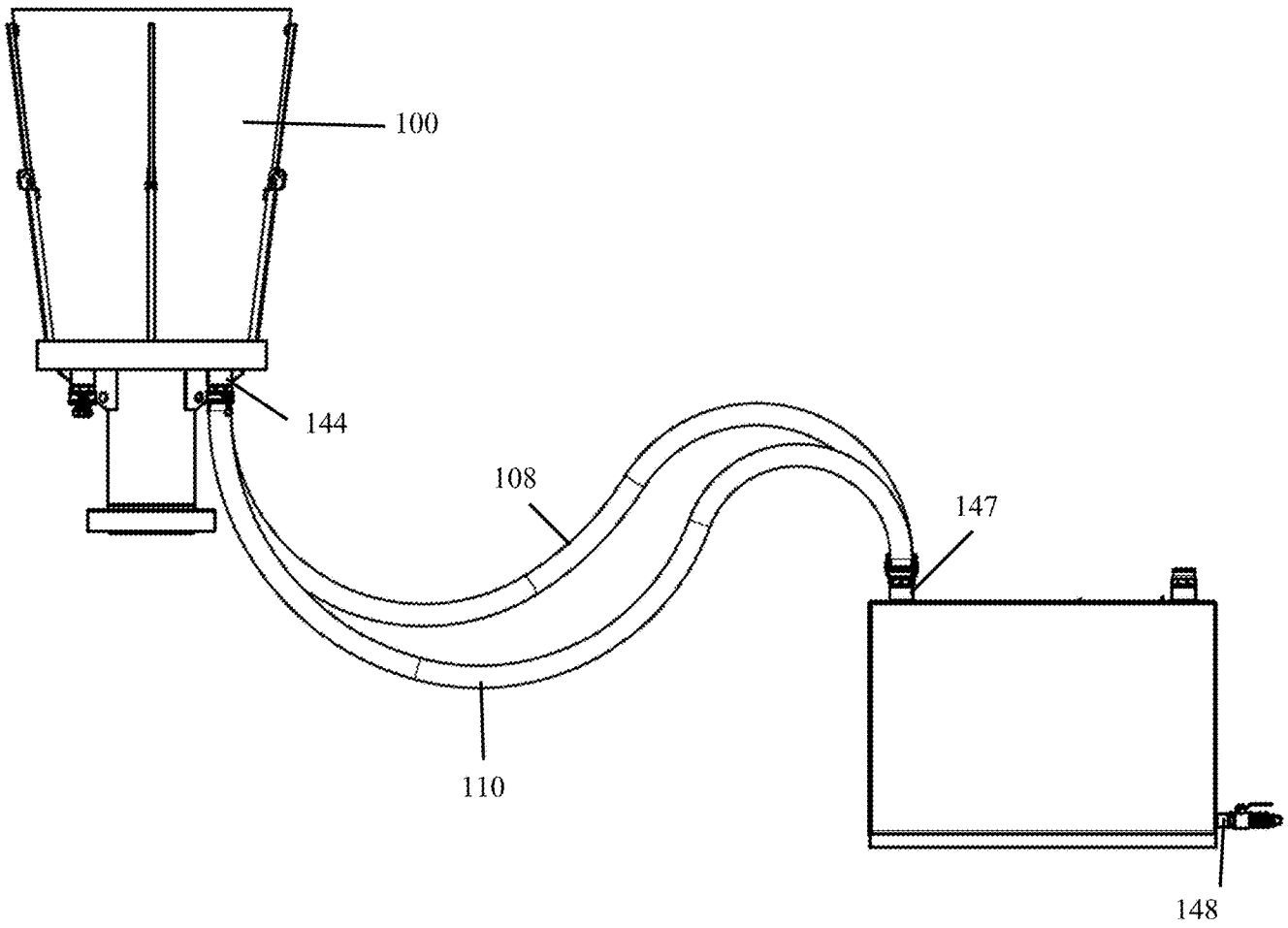
FIG. 5 is an environmental view thereof.

Outlet 144, 144*a*, 144*b*, 144*c* provides a surface for attaching the conduits 108, 110 as shown in FIGS. 3-5. The outlet 144, 144*a*, 144*b*, 144*c* located at exits 136 enables the conduits 108, 110 to attach to pan 101 for draining the pan 101 into containment vessel 116. The conduits 108, 110 secure to inlet 147 of containment vessel 116 for conveying the fluids from the pan 101 to the containment vessel 116. Outlet 148 enables the draining of containment vessel 116.

FIG. 3 also shows the exit 136 closed at outlets 144, 144*a*, 144*b*, 144*c*. Cap 137 seals exit 136 located at each outlet 144, 144*a*, 144*b*, 144*c*. The cap 137 limits the flow of fluids through exit 136. Users may limit the outlets 144, 144*a*, 144*b*, 144*c* from which the fluid flows by placing the caps 137 on the outlet.

FIG. 3 also shows latches 139, 141 that secure the conduits 108, 110 to the outlets 144, 144*a*, 144*b*, 144*c*. The latches 139, 141 limit removal of the conduits 108, 110 from the outlets 144, 144*a*, 144*b*, 144*c*. Fluid flows through the exits 136 of outlets 144, 144*a*, 144*b*, 144*c* through the outlets 108, 110 to the containment vessel 116.

Figure 3A:
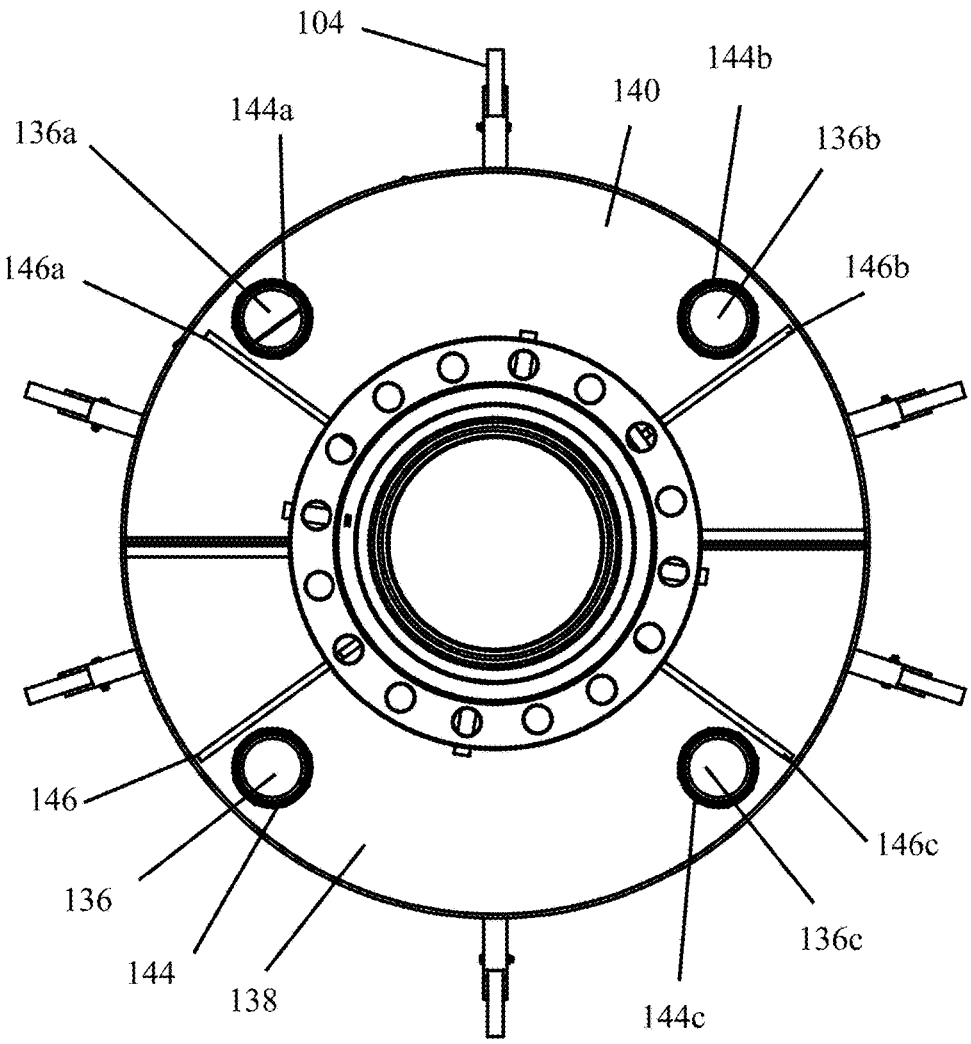
FIG. 3A is a bottom view thereof.

FIG. 3A shows exits 136, 136*a*, 136*b*, 136*c* of the outlets 144, 144*a*, 144*b*, 144*c*. Cap 137 has been removed from the outlets. The user may connect the conduits 108, 110 to the outlets 144, 144*a*, 144*b*, 144*c* for the flow of the fluid.

FIGS. 3 and 3A show an underside of the fluid containment system 100 and pan bodies 138, 140. Supports 146, 146*a*, 146*b*, 146*c* provide continued support on the underside of the pan bodies 138, 140 to maintain the position of pan 101. Supports 146, 146*a*, 146*b*, 146*c* contact the bottom of pan 101 and the body 107. Opening 155 of pan 101 secures around body 107. The contact of supports 146, 146*a*, 146*b*, 146*c* with body 107 maintains the position of the pan 101.

FIG. 4 also shows the aperture 112 allowing flow line 114 to pass through the fluid containment system 100.

Figure 6:
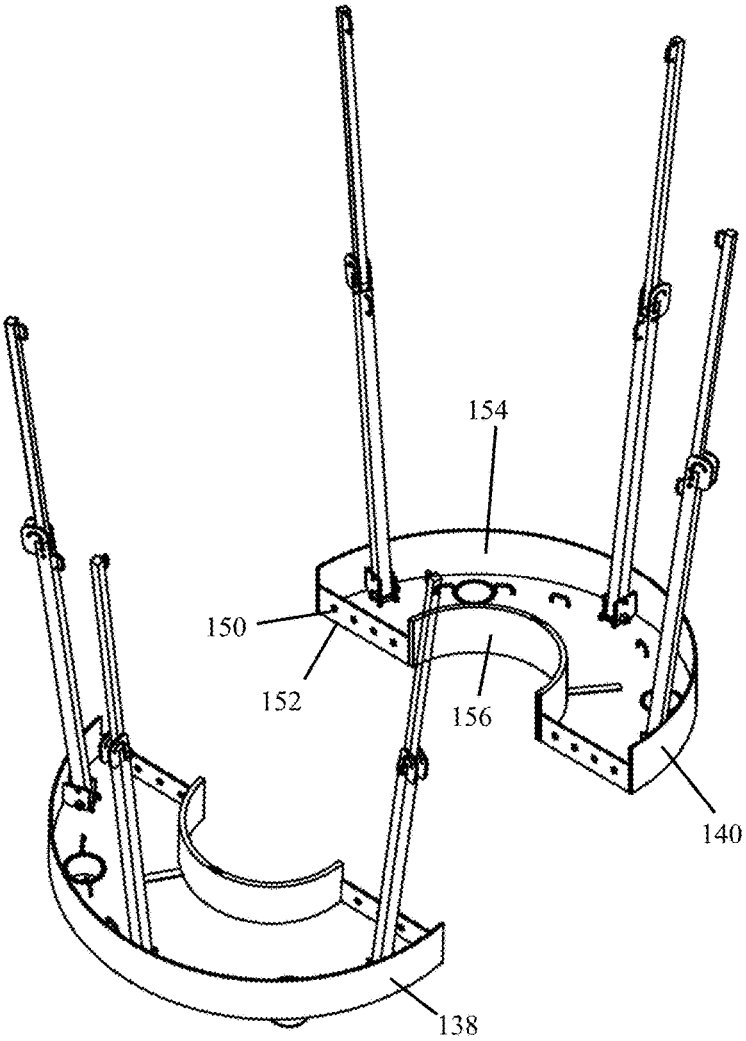
FIG. 6 is a perspective view thereof.

FIG. 6 shows the attachment wall 152 of both pan bodies 138, 140. Fasteners 142, such as bolts, pass through the fastener apertures 150 to secure the pan bodies 138, 140 together. The attachment of pan bodies 138, 140 forms the opening with inner walls 156. Inner walls 156 form a curve that is placed against the body or other drilling equipment located below the bearing assembly.

In one embodiment, the outermost portion of outer wall 154 and innermost portion of inner wall 156 form an open curve. The outer wall 154 and inner wall 156 of one embodiment form an arc having a radius. The outer wall 154 and inner wall 156 of such an embodiment extend radially outward from the center of the opening.

Figure 8:
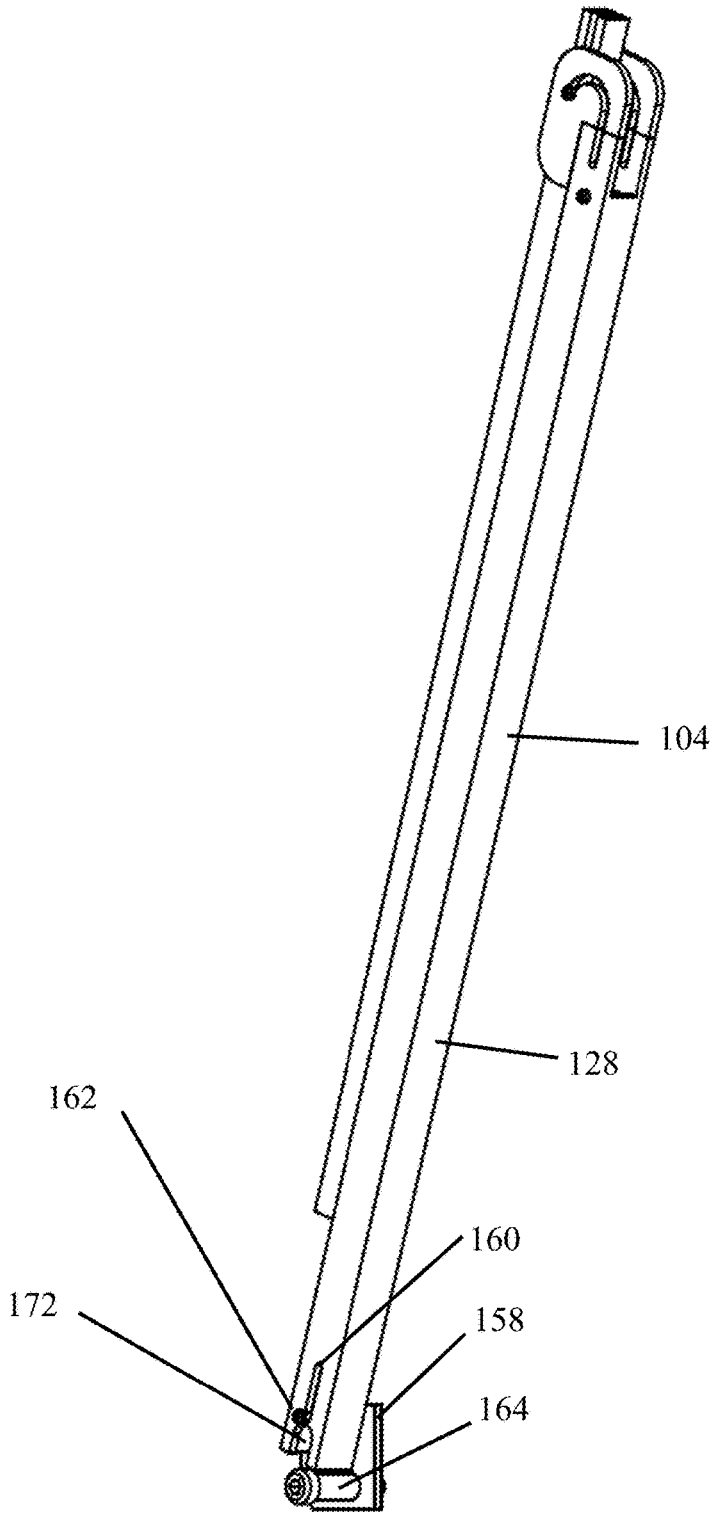
FIG. 8 is a perspective view thereof.

FIGS. 7-8 show the attachment arm 104 in the transport/store position. Fastener 166, such as a guide pin, guide, or other fastener, travels through track 126 to adjust the attachment arm 104 between the transport/store position and the use position. Upper section 122 pivots towards the lower section 128 to reduce the length of the attachment arm 104. In one embodiment, upper section 122 adjusts to a position at or near parallel to lower section 128 to reduce the length of the attachment arm 104. The reduced length improves the ability to store and transport the attachment arm 104.

Fastener 170 of lower section 128 inserts into attachment aperture 168 of the upper section 122. Insertion of the fastener 170 into attachment aperture 168 maintains the position of the upper section 122 in the use position as shown in FIG. 1.

Base 158 attaches to the pan 101. The attachment arm 104 attaches to the base 158. Fastener 162, such as a guide pin, guide, or other fastener, secures the attachment arm 104 to the base 158. Fastener 162 travels within track 160. Track 160 enables the attachment arm to adjust to different positions to allow the attachment arm 104 to extend radially outward and vertically downward for use position as shown in FIG. 1. Track 160 also enables adjustment arm 104 to adjust vertically upward and radially inwards towards body for the transport/storage position to adjust to the transport/storage position.

Fastener 164, such as a dowel pin, rod or other fastener, positions the attachment arm 104 into the use position on base 158. Fastener 164 inserts into aperture 172 of lower section 128 to maintain attachment arm 104 in the use position. Track 160 allows vertical movement of aperture 172 in relation to the fastener 164. The user adjusts lower section 128 upward to release aperture 172 from fastener 164. The user can then pivot attachment arm 104 to the storage/transport position. The user can also adjust lower section 128 downward to insert fastener 164 into aperture 172 to the use position. The lower section 128 pivots at fastener 162.

Figure 9:
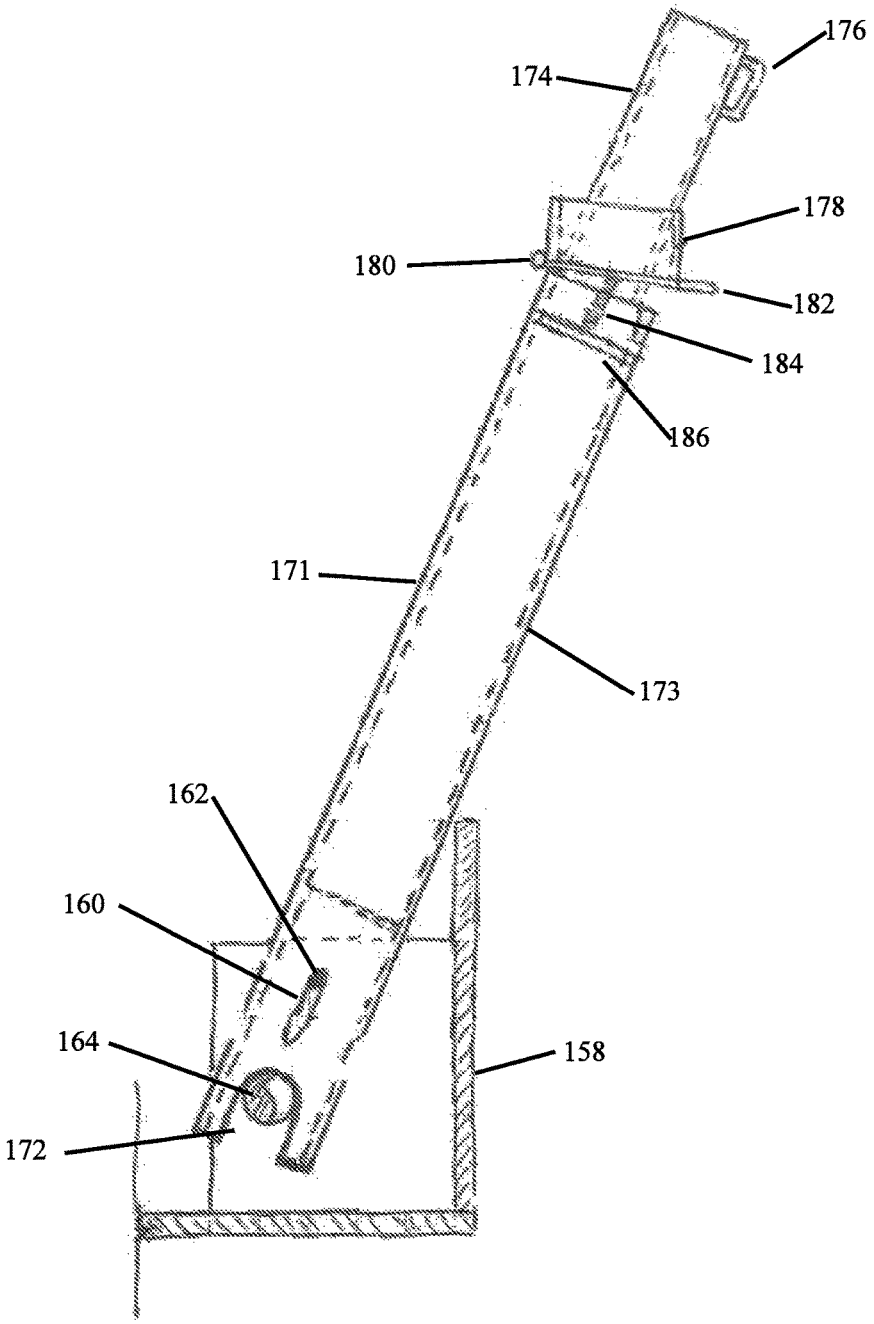
FIG. 9 is a side view of an attachment arm of one embodiment of the present invention.
Figure 10:
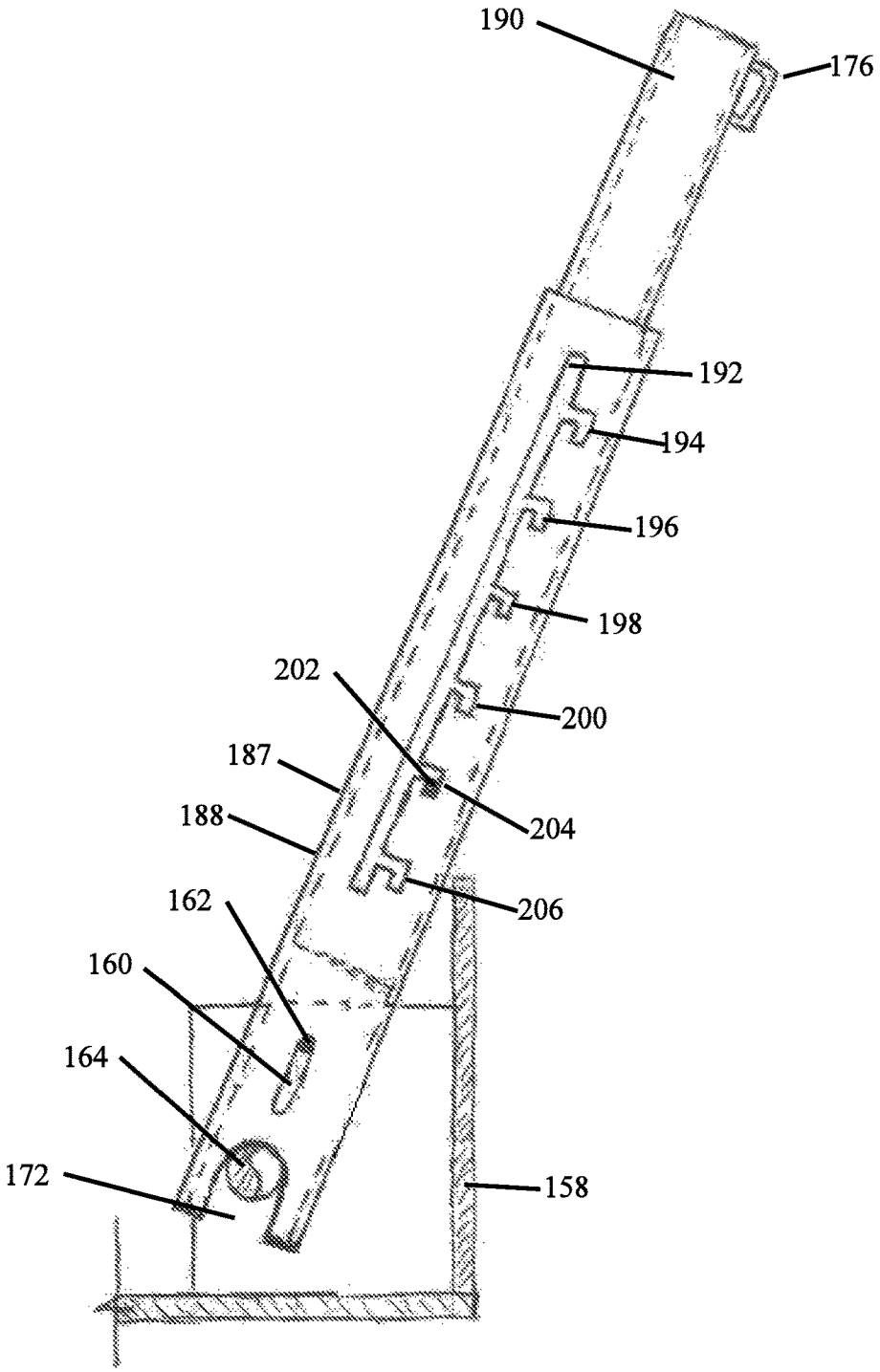
FIG. 10 is a side view of an attachment arm of one embodiment of the present invention.

FIGS. 9 and 10 show alternative versions of the attachment arm 171, 187. FIG. 9 shows a telescoping attachment arm 171. FIG. 10 shows an attachment arm 187 that twists to lock into position. The attachment arms 171, 187 attach to the base 158. Fastener 162 secures the attachment arms 171, 187 to the base 158. Fastener 162 travels within track 160. Track 160 enables the attachment arm 171, 187 to adjust to different positions to allow the attachment arm 171, 187 to extend radially outward and vertically downward for use position as shown in FIG. 1. Track 160 also enables adjustment arm 104 to adjust vertically upward and radially inwards towards body for the transport/storage position to adjust to the transport/storage position.

Continuing to refer to FIGS. 9 and 10, Fastener 164, such as a dowel pin, rod or other fastener, positions the attachment arm 171, 187 into the use position on base 158. Fastener 164 inserts into aperture 172 of lower section 173, 188 to maintain attachment arm 171, 187 in the use position. Track 160 allows vertical movement of aperture 172 in relation to the fastener 164. The user adjusts lower section 173, 188 upward to release aperture 172 from fastener 164. The user can then pivot attachment arm 171, 187 to the storage/transport position. The user can also adjust lower section 173, 188 downward to insert fastener 164 into aperture 172 to the use position. The lower section 173, 188 pivots at fastener 162.

FIG. 9 shows the telescoping attachment arm 171. Upper section 174 telescopes within lower section 173. Attachment arm 174 provides attachment finger 176. The curtain attaches to the upper section 174 at attachment finger 176. The upper section 174 extends outwards from lower section 173.

Locking collar 178 locks the upper section 174 into position. Locking collar 178 secures to lower section 173 via hinge 180. The locking collar 178 adjusts downward to allow adjustment of upper section 174. The user can then extend the upper section 174 outward from lower section 173. The user can also retract upper section 174 within the lower section 173. The spring then adjusts the locking collar 178 upwards to lock the upper section 174 into position.

Spring 184 biases the locking collar 178 into the locked position. The spring 184 attaches to the locking collar 178 and spring mount 186 located vertically below locking collar 178. The spring 178 returns the locking collar 178 to the closed position.

Handle 182 provides an extension from locking collar 178. The user lowers handle 182 downward toward lower section 173. The downward movement of handle 182 and locking collar 178 unlocks the locking collar 178 to adjust the positioning of upper section 174 and attachment finger 176. The spring 184 adjusts the upper section 174 upward to the use position. Spring 184 then returns the locking collar 178 to the locked position. Spring 184 also assists with maintaining the locking collar 178 in the locked position.

FIG. 10 shows the attachment arm 187 that a user twists and pulls to adjust. The user adjusts the height of the attachment finger 176 from the lower section 188. Upper section 190 has a smaller cross section than lower section 188 such that upper section 190 fits within lower section 188. Upper section 190 rotates within lower section 188 allowing movement of fastener 204 within track 192. Upper section 190 also adjusts both vertically upward and downward for movement of fastener 204 within track 192.

The fastener 204 travels throughout track 192. Track 192 provides slots 194, 196, 198, 200, 202, 206 that accept fastener 204. Fastener 204 fits into slots 194, 196, 198, 200, 202, 206 to adjust the position and height of attachment finger 176. The user can place the fastener 204 within one of the slots 194, 196, 198, 200, 202, 206 to set the height of attachment finger 176. Placement of fastener 204 into one of the slots 194, 196, 198, 200, 202, 206 maintains the position of the upper section 190 and attachment finger 176. The track 192 provides a pathway to each of the slots 194, 196, 198, 200, 202, 206. The slots 194, 196, 198, 200, 202, 206 provide a path that runs laterally or perpendicularly from the track 192. The slots 194, 196, 198, 200, 202, 206 then extend downwards to prevent the fastener 204 from returning to the track 192 from the slots 194, 196, 198, 200, 202, 206.

The present invention also provides a method of containing fluids at a drilling operation. The user installs a pan below the bearing assembly. The pan can be installed on the body or other drilling equipment located below the bearing assembly.

Two pan bodies attach to one other to form an opening, such as a central opening. The pan bodies are placed around body or other drilling equipment at which the pan is to be installed. The user connects the two pan bodies to each other to secure the pan around the body or other drilling equipment.

The user also raises the attachment arms so that the attachment arms extend vertically above the pan. The user attaches a curtain to the attachment arms. The user may secure the curtain with clips, carabiners, or other connection devices to the attachment fingers of the attachment arms. A lower portion of the curtain, such as the bottom of the curtain, attaches to attachment fingers located on the floor of the pan.

The user also secures conduits, such as hoses, to the outlets of the pan for draining the pan. The conduits lead to a containment vessel, tank, or other storage for conveying the fluids from the pan to the containment vessel. The user can then drain the containment vessel to reduce the amount of fluid stored within the containment vessel.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A fluid containment system that attaches to a wellhead below a flowline of the rotating bearing assembly, the system comprising:

a first pan body;

a floor of the first pan body;

a second pan body attachable to the first pan body wherein the first pan body and the second pan body secure to the wellhead below the flowline;

a floor of the second pan body;

a first attachment arm extending vertically above the first pan body, the first attachment arm secured to the floor of the first pan body inward from an outer edge of the first pan body;

a second attachment arm extending vertically above the second pan body, the second attachment arm secured to the floor of the second pan body inward from an outer edge of the second pan body;

a curtain that attaches to the first attachment arm and the second attachment arm, wherein the curtain attaches to the floor of the first pan body and the floor of the second pan body inward from the outer edge of the first pan body and the second pan body.

2. The system of claim 1 further comprising:

an inner wall of the first pan body extending vertically above the floor;

an inner wall of the second pan body extending vertically above the floor.

3. The system of claim 2 wherein the inner wall of the first pan body and the second pan body are located radially inward from the floor.

4. The system of claim 3 further comprising:

an outer wall of the first pan body extending vertically above the floor, the outer wall located laterally outward from the inner wall;

an outer wall of the second pan body extending vertically above the floor, the outer wall located laterally outward from the inner wall.

5. The system of claim 4 wherein the outer wall of the first pan body is located radially outward from the inner wall; and the outer wall of the second pan body is located radially outward from the inner wall.

6. The system of claim 4 wherein the floor is located between the inner wall and the outer wall.

7. The system of claim 1 further comprising:

an attachment finger of the attachment arm wherein the curtain attaches to the attachment arm at the attachment finger.

8. The system of claim 6 further comprising:

a floor attachment finger of the floor of the first pan body wherein the floor attachment finger extends vertically above the floor wherein the curtain attaches to the floor of the first pan body at the floor attachment finger, wherein the floor attachment finger is located between the inner wall and the outer wall of the first pan body.

9. The system of claim 8 further comprising:

an outlet located in the floor wherein the outlet provides an opening to allow fluids to pass vertically down through the floor.

10. The system of claim 9 further comprising:

a conduit secured to the outlet;

a containment vessel secured to the conduit wherein fluid flows from the outlet to the containment vessel through the conduit.

11. The system of claim 1 further comprising:

an opening in the curtain wherein the flowline passes through the opening wherein the curtain extends above and below the flowline.

12. A fluid containment system that attaches to a wellhead below a flowline of the rotating bearing assembly, the system comprising:

a first pan body;

a second pan body attachable to the first pan body wherein the first pan body and the second pan body secure to the wellhead below the flowline;

an opening formed between the first pan body and the second pan body when the first pan body attaches to the second pan body;

a floor of the first pan body located laterally outward from the opening;

a floor of the second pan body located laterally outward from the opening;

an outer wall of the first pan body extending vertically above the floor, wherein the outer wall of the first pan body is located laterally outward from the floor of the first pan body;

an outer wall of the second pan body extending vertically above the floor, wherein the outer wall of the second pan body is located laterally outward from the floor of the second pan body;

a first attachment arm extending vertically above the first pan body, wherein the first attachment arm attaches to the floor of the first pan body laterally inward from the outer wall;

a second attachment arm extending vertically above the second pan body, wherein the second attachment arm attaches to the floor of the second pan body laterally inward from the outer wall; and a curtain that attaches to the first attachment arm and the second attachment arm wherein the curtain extends vertically above the flowline and vertically below the flowline, wherein the curtain attaches to the floor of the first pan body laterally inward from the outer wall of the first pan body, and wherein the curtain attaches to the floor of the second pan body laterally inward from the outer wall of the second pan body.

13. The system of claim 12 wherein the first attachment arm pivotally attaches to the floor of the first pan body.

14. The system of claim 12 further comprising:

an inner wall of the first pan body extending vertically above the floor;

an inner wall of the second pan body extending vertically above the floor, the outer wall of the first pan body located laterally outward from the inner wall of the first pan body;

the outer wall of the second pan body located laterally outward from the inner wall of the second pan body;

the first attachment arm secured to the floor of the first pan body between the inner wall and the outer wall of the first pan body; and the second attachment arm secured to the floor of the second pan body between the inner wall and the outer wall of the second pan body.

15. The system of claim 14 wherein the floor is located between the inner wall and the outer wall;

a floor attachment finger of the floor of the first pan body wherein the floor attachment finger extends vertically above the floor wherein the curtain attaches to the floor of the first pan body at the floor attachment finger, wherein the floor attachment finger is located between the inner wall and the outer wall of the first pan body, the curtain attaching to the floor attachment finger between the inner wall and the outer wall of the first pan body.

16. The system of claim 15 further comprising:

an attachment finger of the attachment arm located vertically above the flowline wherein the curtain attaches to the attachment arm at the attachment finger above the flowline.

17. The system of claim 16 further comprising:

an outlet located in the floor wherein the outlet provides an opening to allow fluids to pass vertically down through the floor;

a conduit secured to the outlet;

a containment vessel secured to the conduit wherein fluid flows from the outlet to the containment vessel through the conduit.

18. The system of claim 12 further comprising:

an upper section of the first attachment arm;

a lower section of the first attachment arm wherein the upper section telescopes into the lower section.

19. A fluid containment system that attaches to a wellhead below a flowline of the rotating bearing assembly, the system comprising:

a first pan body;

a second pan body attachable to the first pan body wherein the first pan body and the second pan body secure to the wellhead below the flowline;

a first attachment arm extending vertically above the first pan body wherein the first attachment arm extends above the flowline;

a second attachment arm extending vertically above the second pan body wherein the second attachment arm extends above the flowline;

a curtain that attaches to the first attachment arm and the second attachment arm above the flowline wherein the curtain extends vertically above the flowline and vertically below the flowline;

a floor of the first pan body and the second pan body wherein the curtain attaches to the floor;

an outlet located in the floor wherein the outlet provides an opening to allow fluids to pass vertically down through the floor;

a first support secured to the rotating bearing assembly wherein the first support extends radially outward from the rotating bearing assembly or the wellhead, the first support secured below the first pan body wherein the first pan body contacts the first support, the first pan body resting upon the first support wherein the first support supports the first pan body;

a second support secured to the rotating bearing assembly wherein the second support extends radially outward from the rotating bearing assembly or the wellhead, the second support secured below the second pan body wherein the second pan body contacts the second support, the second pan body resting upon the second support wherein the second support supports the second pan body.

20. The system of claim 19 further comprising:

an upper section of the first attachment arm;

a lower section of the first attachment arm wherein the upper section telescopes into the lower section;

an upper attachment finger located on the upper section;

a lower attachment finger located on the lower section wherein the curtain attaches to the upper attachment finger and the lower attachment finger.

* * * * *